US010584889B2

(12) United States Patent
Situ

(10) Patent No.: US 10,584,889 B2
(45) Date of Patent: Mar. 10, 2020

(54) MAGNETIC SWITCH CONTROLLED CIRCUIT FOR ELECTRICAL APPLIANCE

(71) Applicant: Hua Fu Situ, Monterey Park, CA (US)

(72) Inventor: Hua Fu Situ, Monterey Park, CA (US)

( * ) Notice: Subject to any disclaimer, the term of this patent is extended or adjusted under 35 U.S.C. 154(b) by 466 days.

(21) Appl. No.: 15/462,476

(22) Filed: Mar. 17, 2017

(65) Prior Publication Data

US 2018/0190459 A1 Jul. 5, 2018

Related U.S. Application Data

(60) Provisional application No. 62/441,403, filed on Jan. 1, 2017.

(51) Int. Cl.

| | |
|---|---|
| ***H01H 47/32*** | (2006.01) |
| ***H01H 47/18*** | (2006.01) |
| ***F24F 9/00*** | (2006.01) |
| ***F24F 11/89*** | (2018.01) |
| ***F24F 11/88*** | (2018.01) |
| *H01H 36/00* | (2006.01) |

(52) U.S. Cl.

CPC ..... *F24F 9/00* (2013.01); *F24F 11/88* (2018.01); *F24F 11/89* (2018.01); *F24F 2009/005* (2013.01); *H01H 36/0046* (2013.01)

(58) Field of Classification Search

CPC ..... B60J 5/08; B60R 25/1003; B60R 25/104; B66B 1/50; E05F 15/668; E05F 15/79; E05Y 2400/324; E05Y 2400/51; E05Y 2800/70; E05Y 2900/106; F24F 11/88; F24F 11/89; F24F 2009/005; F24F 9/00; G08B 13/08; G08B 23/00; H01H 36/0046; H01H 9/0207; H01R 13/447; H01R 13/701

See application file for complete search history.

(56) References Cited

U.S. PATENT DOCUMENTS

| | | | | |
|---|---|---|---|---|
| 6,563,278 | B2 * | 5/2003 | Roman | E05F 15/70 318/280 |
| 6,597,291 | B2 * | 7/2003 | Tsui | E05F 15/43 340/5.7 |
| 7,342,368 | B2 * | 3/2008 | Roman | E05F 15/70 318/280 |
| 10,106,081 | B2 * | 10/2018 | Lu | B62D 15/027 |
| 2001/0013762 | A1 * | 8/2001 | Roman | E05F 15/70 318/282 |

(Continued)

*Primary Examiner* — Thienvu V Tran
*Assistant Examiner* — Nicolas Bellido
(74) *Attorney, Agent, or Firm* — Tsz Lung Yeung

(57) ABSTRACT

A magnetic switch controlled circuit for an electrical appliance includes a voltage input terminal, a voltage output terminal, a magnetic switch, a relay circuitry and a turn-off delay circuitry. When the magnetic switch detects a first change in the magnetic field from an idle status, the relay circuitry is configured to output an output voltage to the voltage output terminal so as to supply power to the electrical appliance. When the magnetic switch detects a second change in the magnetic field from the first change in the magnetic field, the turn-off delay circuitry is configured to control the relay circuitry to continue outputting the output voltage to the voltage output terminal for a predetermined period of time, the relay circuitry being switched off by the turn-off delay circuitry after the predetermined period of time elapses.

10 Claims, 7 Drawing Sheets

(56) References Cited

U.S. PATENT DOCUMENTS

| | | | | |
|---|---|---|---|---|
| 2005/0174204 | A1* | 8/2005 | Gilmore | H01H 36/0046 335/207 |
| 2007/0024442 | A1* | 2/2007 | Jolley | E05B 17/10 340/542 |
| 2012/0188077 | A1* | 7/2012 | Sawyer | E05F 15/668 340/540 |

* cited by examiner

MAGNETIC SWITCH CONTROLLED CIRCUIT FOR ELECTRICAL APPLIANCE

BACKGROUND OF THE PRESENT INVENTION

Field of Invention

The present invention relates to a switch circuit, and more particularly to a magnetic switch controlled circuit which may be used to switch on or switch off an electrical appliance such as an air curtain apparatus.

Description of Related Arts

Conventional mechanical switches, such as a mechanical switch used for controlling an air curtain apparatus, have widely been utilized. A conventional mechanical switch is usually bulky in size, and must be mounted on an object through some sorts of connectors or other mechanical tools. As a result, when the mechanical switch was improperly installed, it may not function at all. Moreover, conventional mechanical switches suffer from mechanical wear and tear when they have used for a certain period of time. In some situations, mechanical switches may be directly connected to high-voltage electrical components so that the wires connected to the mechanical switches must be specifically designed to be of very high quality and therefore very expensive. The connection to mechanical switches requires hard wires for high-voltage application, and requires to hire a licensed electrical technician with higher installation cost.

Referring to FIG. 1A and FIG. 1B of the drawings, if the door panel 10P swings outwardly, the mechanical switch 1P may be mounted on one side or an upper side of the door frame 20P. If the door panel 10P swings inwardly, the mechanical switch 1P may be mounted on the door frame 20P by using a metal sheet to create brackets 30P. If the door panel 10P swings in and out as shown in FIG. 1C of the drawings, the mechanical switch 1P should be placed with a roller plunger 40P provided on the upper side of the door frame 20P with a metal bracket 50P mounted on the top of the door panel 10P.

FIG. 1D and FIG. 1E illustrate that the mechanical switch 1P may be used in a sliding door 60P and a roll-up door 70P. As shown in the drawings, many other mechanical and electrical accessories or tools must be used to mount the mechanical switch 1P. These mechanical installation mechanisms are relatively complicated and time-consuming.

As a result, there is a need to develop a switch which may easily be mounted on different locations.

SUMMARY OF THE PRESENT INVENTION

Certain variations of the present invention provide a magnetic switch controlled circuit to control a relay output, and act as a switch to turn on or turn off an electrical appliance such as an air curtain apparatus, a lighting device, and an electrical equipment, etc.

Certain variations of the present invention provide a magnetic switch controlled circuit with a magnetic switch with turn-off delay to control a relay output, and act as a switch to turn on or turn off an electrical appliance such as an air curtain apparatus, a lighting device, and an electrical equipment, etc.

Certain variations of the present invention provide a magnetic switch controlled circuit with a magnetic switch with turn-off delay to control a relay output, and act as a switch to turn on or off an electrical appliance after a predetermined period of time for preventing undesirable damage to the electrical appliance.

In one aspect of the present invention, it provides a magnetic switch controlled circuit for an electrical appliance, comprising:

a voltage input terminal adapted for electrically connecting to an external power source;

a voltage output terminal adapted for electrically connecting to an electrical appliance;

a magnetic switch configured to detect a change in magnetic field;

a relay circuitry electrically connected to the magnetic switch, wherein when the magnetic switch detects a first change in the magnetic field from an idle status, the relay circuitry is configured to output an output voltage to the voltage output terminal so as to supply power to the electrical appliance; and a turn-off delay circuitry electrically connected to the relay circuity, wherein when the magnetic switch detects a second change in the magnetic field from the first change in the magnetic field, the turn-off delay circuitry is configured to control the relay circuitry to continue outputting the output voltage to the voltage output terminal for a predetermined period of time, the relay circuitry being switched off by the turn-off delay circuitry after the predetermined period of time elapses.

This summary presented above is provided merely to introduce certain concepts and not to identify any key or essential features of the claimed subject matter.

DETAILED DESCRIPTION OF THE PREFERRED EMBODIMENT

Figure 1B:
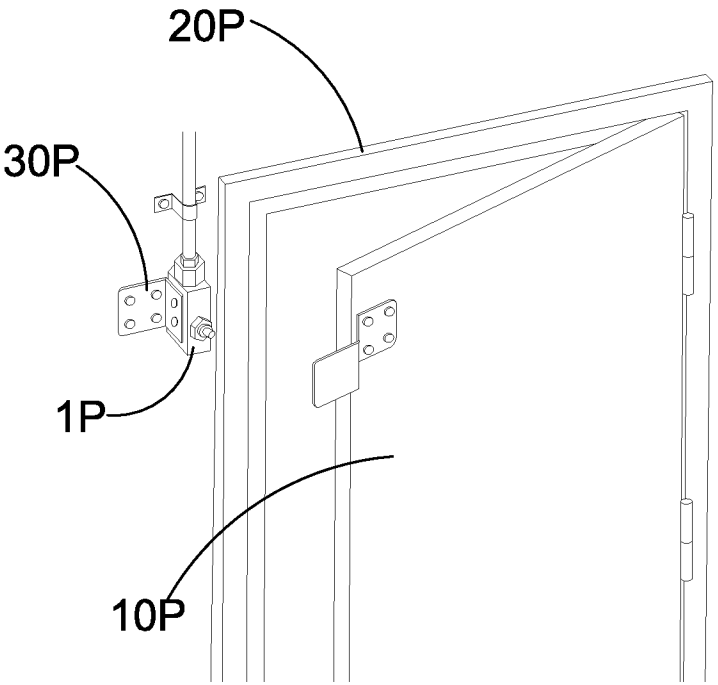
FIG.1B PRIOR ART
FIG. 1B is a schematic diagram of a conventional mechanical switch, illustrating that the mechanical switch is mounted on a door frame having a door panel which swings inwardly.
Figure 1A:
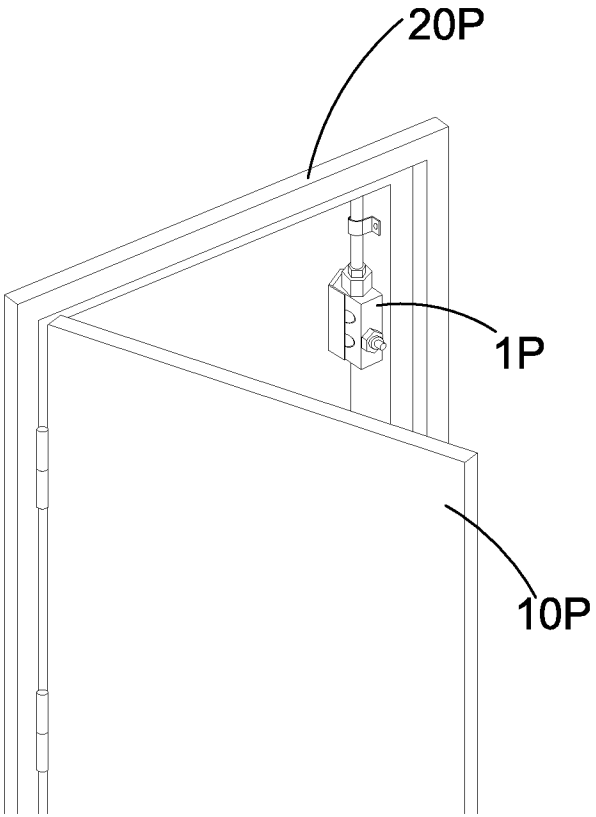
FIG.1A PRIOR ART
FIG. 1A is a schematic diagram of a conventional mechanical, illustrating that the mechanical switch is mounted on a door frame having a door panel which swings outwardly.
Figure 1C:
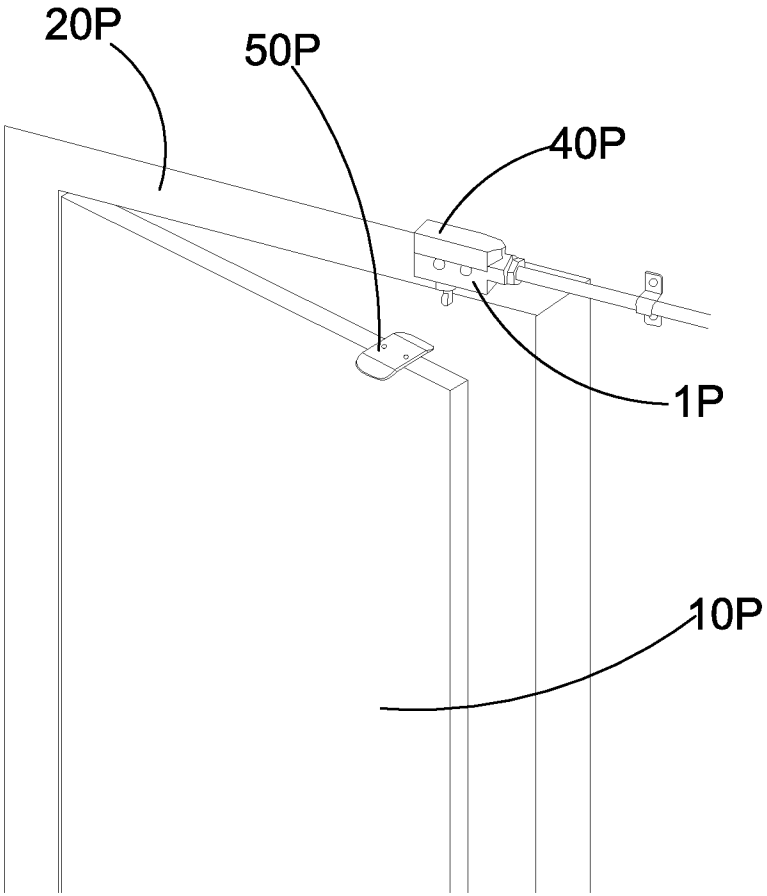
FIG.1C PRIOR ART
FIG. 1C is a schematic diagram of a conventional mechanical switch, illustrating that the mechanical switch is mounted on a door frame having a door panel which swings inwardly and outwardly.
Figure 1E:
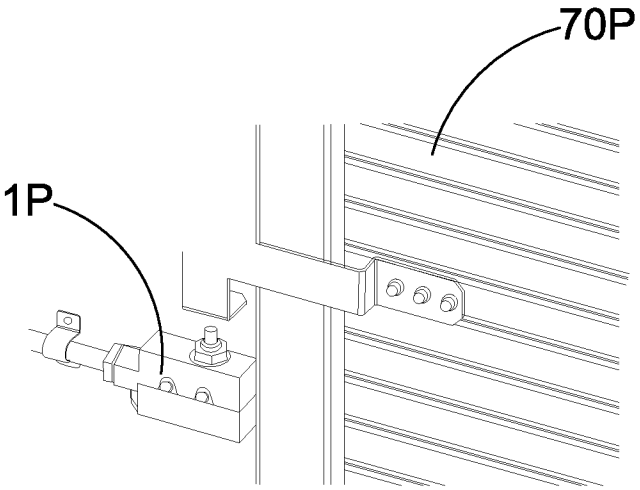
FIG.1E PRIOR ART
FIG. 1E is a schematic diagram of a conventional mechanical switch, illustrating that the mechanical switch is mounted on a roll-up door.
Figure 1D:
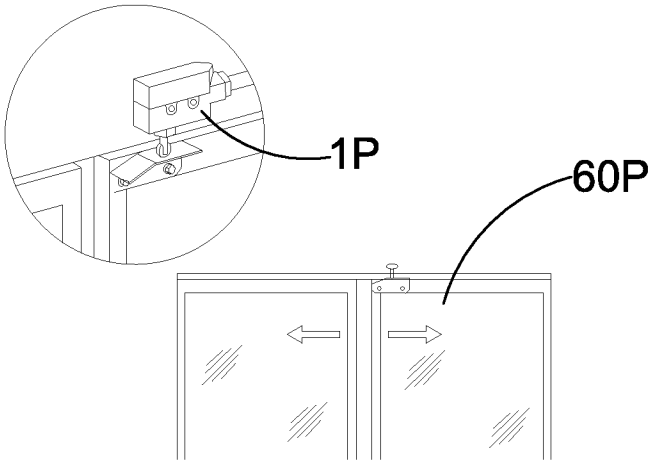
FIG.1D PRIOR ART
FIG. 1D is a schematic diagram of a conventional mechanical switch, illustrating that the mechanical switch is mounted on a sliding door.
Figure 2:
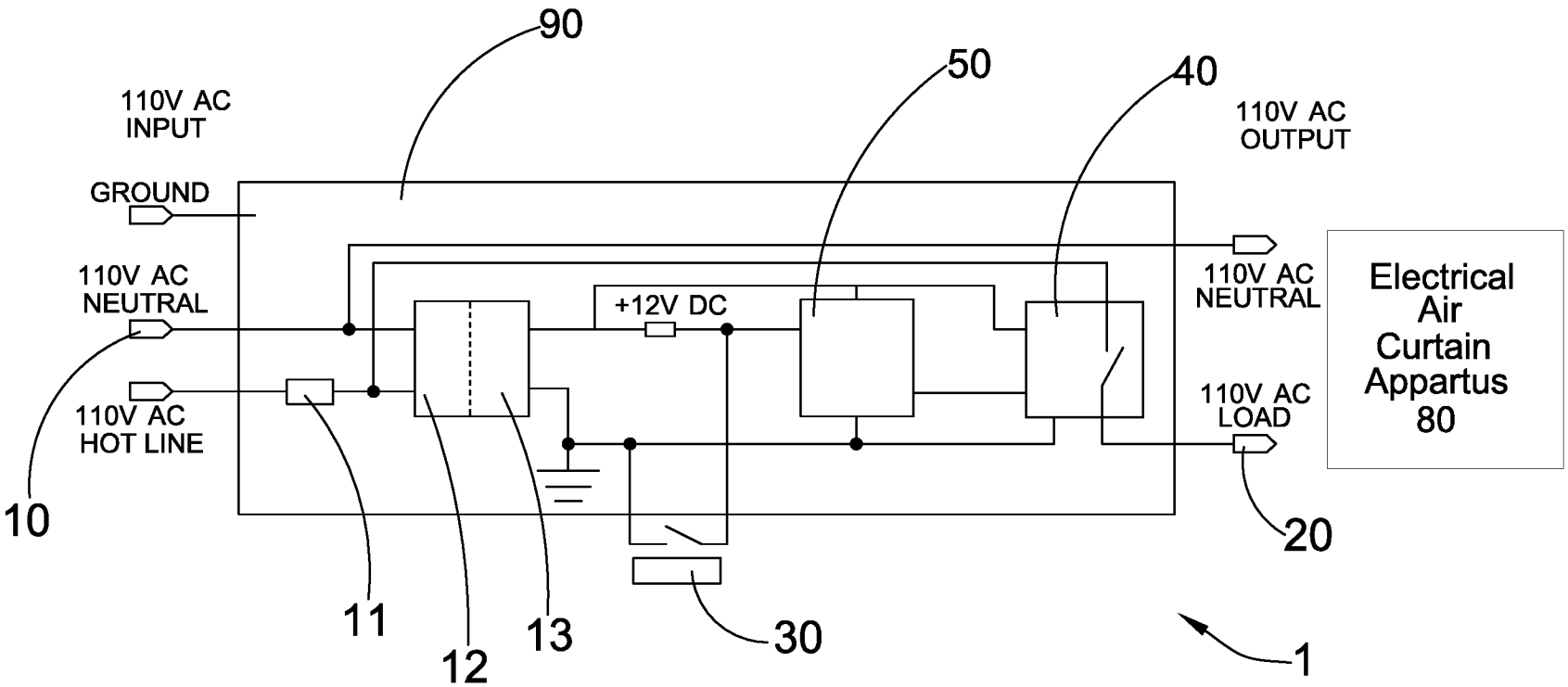
FIG. 2 is a block diagram of a magnetic switch controlled circuit according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIGS. 2 to 5 of the drawings, a magnetic switch controlled circuit 1 according a preferred embodiment of the present invention is illustrated. Broadly, the magnetic switch controlled circuit 1 may comprise a voltage input terminal 10, a voltage output terminal 20, a magnetic switch 30, a relay circuitry 40 and a turn-off delay circuitry 50. The magnetic switch controlled circuit is for controlling the on/off of an electrical appliance, such as an electrical air curtain apparatus 80

The voltage input terminal 10 may be adapted for electrically connecting to an external power source, such as an external Alternating Current (AC) power source.

The voltage output terminal 20 may be adapted for electrically connecting to an electrical appliance, such as the air curtain apparatus 80, and may allow AC power output to the electrical appliance.

The magnetic switch 30 may be configured to detect a change in magnetic field in the vicinity of the magnetic switch 30. The relay circuitry 40 may be electrically connected to the magnetic switch 30, wherein when the magnetic switch 30 detects a first change in the magnetic field from an idle status, the relay circuitry 40 is configured to output an output voltage to the voltage output terminal 20 so as to supply power to the electrical appliance.

The turn-off delay circuitry 50 may be electrically connected to the relay circuitry 40, wherein when the magnetic switch 30 detects a second change in the magnetic field from the first change in the magnetic field, the turn-off delay circuitry 50 is configured to control the relay circuitry 40 to continue outputting the output voltage to the voltage output terminal 20 for a predetermined period of time. The relay circuitry 40 may be switched off by the turn-off delay circuitry 50 after the predetermined period of time elapses.

According to the preferred embodiment of the present invention, the voltage input terminal 10, the voltage output terminal 20, the relay circuitry 40 and the turn-off delay circuitry 50 may be connected and implemented on a Printed Circuit Board (PCB) 90. The magnetic switch 30 may act as a switch to turn on/off an electrical appliance such as the electrical air curtain apparatus 80.

The magnetic switch controlled circuit 1 may further comprise a replaceable fuse 11 electrically connected to the relay circuitry 40 and the turn-off delay circuitry 50 for protecting the entire circuit from over current. The maximum current may be set at 15A, or other values depending on manufacturing and operational circumstances.

The magnetic switch controlled circuit 1 may further comprise a transformer 12 which is configured to convert alternating current drawn from the external AC power source to a stepped-down AC power. As an example, the transformer may be arranged to transform 110V-120V AC power (obviously, the AC power can have other voltages as well) to 12V AC power. The transformer 12 may be electrically connected between the voltage input terminal 10 and the relay circuitry 40 and the turn-off delay circuitry 50. Note that the AC power denoted above may mean root means square (r.m.s.) value.

The magnetic switch controlled circuit 1 may further comprise a rectifying circuitry 13 electrically connected between the transformer 12 and the relay circuitry 40 and the turn-off delay circuitry 50. The rectifying circuitry 13 may be configured to rectify AC power output from the transformer 12 to direct current (DC) power.

Figure 3:
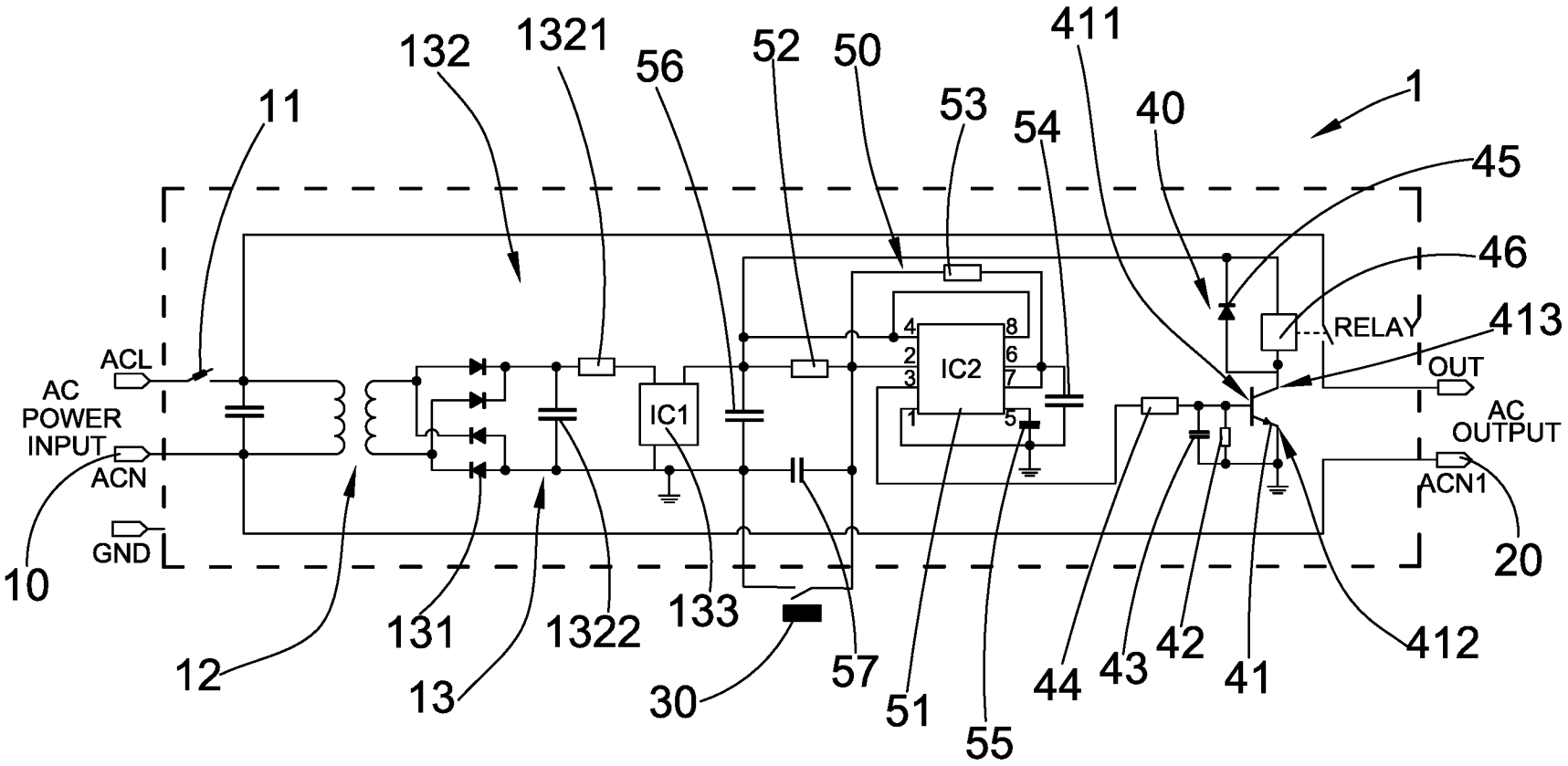
FIG. 3 is a circuit schematic diagram of a magnetic switch controlled circuit according to the preferred embodiment of the present invention.
Figure 4:
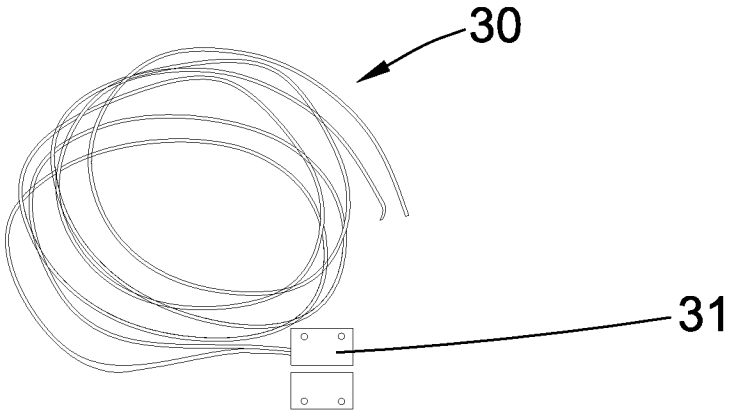
FIG. 4 is a schematic diagram of a magnetic switch controlled circuit according to the preferred embodiment of the present invention.
Figure 5:
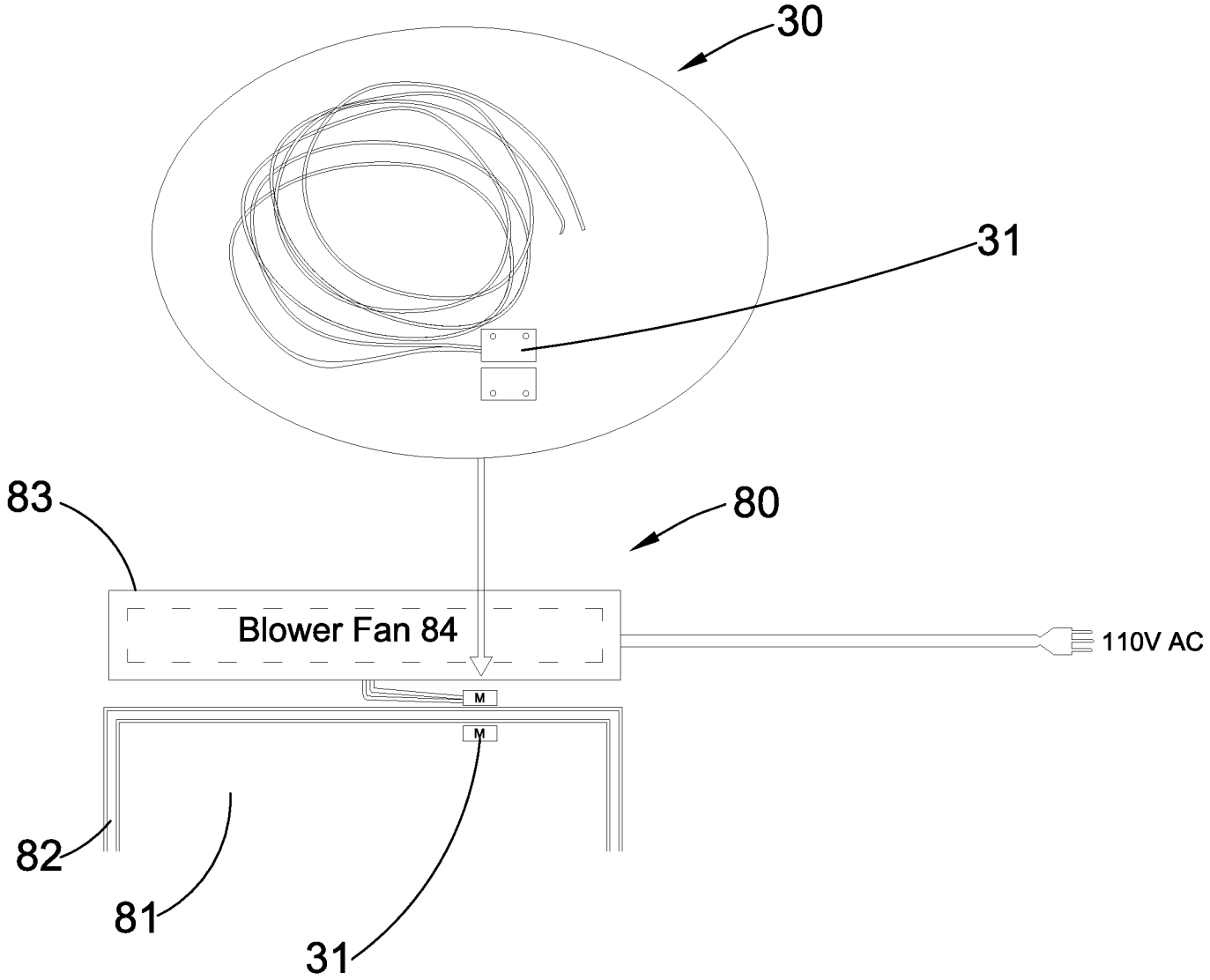
FIG. 5 is a schematic diagram of a magnetic switch controlled circuit according to the preferred embodiment of the present invention, illustrating that the magnetic switch controlled circuit may be utilized to control an air curtain apparatus.

As shown in FIG. 3 of the drawings, the rectifying circuitry 13 may comprise a plurality of diodes 131 arranged in parallel configuration, a filter 132 electrically connected to the diodes 131, and a first integrated circuit (IC) 133 electrically connected to the filter 132. The filter 132 may be configured as having a predetermined transfer function and comprise a first capacitor 1321 and a first resistor 1322 connected in parallel with each other. The AC voltage output from the transformer 12 may first be rectified to a DC voltage by the diodes 131 and the filter 132. The first IC 133 may further reduce the rectified DC voltage to a predetermined DC voltage for use by the magnetic switch 30, the relay circuitry 40 and the turn-off delay circuitry 50. As an example, the transformer 12 may output a 12V AC which may be rectified to be about 15V DC. The first IC 133 may further reduce the 15V DC to 12V DC for use by the magnetic switch 30, the relay circuitry 40 and the turn-off delay circuitry 50. Of course, other voltage values are also possible.

The magnetic switch 30 (12V) may control the switching of the relay circuitry 40 through a turn-off delay circuitry 50. The switching on or the switching off of the relay circuitry 40 may controls AC outputted to the electrical appliance.

Specifically, the magnetic switch 30 may comprise a plurality of switching members 31 mounted on different places of the electrical appliance or on any suitable locations. For example, one of the switching members 31 may be mounted on a door panel 81 while the other switching member 31 may be mounted on the door frame 82, so that when the door panel 81 closes or opens, the distance between the two switching members 31 will vary and this subsequently affect the magnetic field between the two switching members 31.

In this preferred embodiment, when the switching members 31 are positioned apart from each other (such as when the door panel 81 is opened with respect to the door frame 82), the magnetic switch 30 may be configured to close so as to supply power to the electrical appliance (described below in more details). On the other hand, when the switching members 31 are positioned close to each other (such as when the door panel 81 is closed with respect to the door frame 82), the magnetic switch 30 may be configured to open so as to cut off power supply to the electrical appliance (also described below in more details). According to the preferred embodiment of the present invention, the magnetic switch 30 may normally be kept opened.

The relay circuitry 40 may comprise a transistor 41, a second resistor 42, a second capacitor 43, a third resistor 44, a relay diode 45, and a relay switch 46 connected in a configuration shown in FIG. 3 of the drawings. Specifically, the second resistor 42 and the second capacitor 43 are connected in parallel. The transistor 41 may be embodied as a bipolar junction transistor having a base terminal 411, an emitter terminal 412 and a collector terminal 413. The emitter terminal 412 may be connected to the ground and to the second resistor 42. The base terminal 411 may be connected to the second resistor 42 in series, while the second resistor 42 may be connected to the second capacitor 43 in parallel. The third resistor 44 may be connected between the turn-off delay circuitry 50 and the second capacitor 43. The relay switch 46 may be connected to the collector terminal 413 of the transistor 41. The relay switch 46 may also be connected to the relay diode 45 in parallel.

The configuration described above may be schematically depicted in FIG. 3 of the drawings.

The turn-off delay circuitry 50 may further comprise a second Integrated Circuit (IC) 51, a fourth resistor 52, a fifth resistor 53, and third through sixth capacitor 54, 55, 56, 57. The arrangement and configuration of these elements are schematically depicted in FIG. 3 of the drawings. Specifically, the second IC 51 may have eight pins (pin 1-8 shown in FIG. 3) and may be programmed to control the operation of the relay circuitry 40.

With reference to FIG. 3 of the drawings, pin 1 may be connected to the ground, and to the third capacitor 54 and the fourth capacitor 55. Pin 2 may be connected to the fourth resistor 52, the fifth resistor 53, the sixth capacitor 57, and the magnetic switch 30. Pin 3 may be connected to the third resistor 44 of the relay circuitry 40. Pin 4 may be connected to pin 8, the first IC 133 of the rectifying circuitry 13, the relay diode 45 and the relay switch 46.

On the other hand, pin 5 of the second IC 51 may be connected to the fourth capacitor 55 which may be connected to the ground, to pin 1 of the second IC 51, and to the third capacitor 54. Pin 6 of the second IC 51 may be connected to the third capacitor 54, pin 7 and the fifth resistor 53. Pin 7 may be connected to the pin 6, the third capacitor 54, and the fifth resistor 53. Pin 8 may be connected to pin 4, the relay circuitry 40, and the rectifying circuitry 13. The exact configuration of the connection between these elements may be graphically and schematically depicted in FIG. 3 of the drawings.

The operation of the present invention may be described as follows: when the magnetic switch 30 detects a first change in magnetic field from idle status and closes, the switching members 31 may be positioned apart from each other (this may correspond to a situation where a door panel 81 is opened with respect to the door frame 82), and the 12V DC rectified by the rectifying circuitry 13 may be arranged to trigger the relay circuitry 40 which turns on the main power source of the electrical appliance. The magnetic switch 30 may be arranged to close and pull the voltage of pin 2 of the second IC 51 to ground. After that, pin 3 of the second IC 51 may go to "High" to turn on the relay switch 46 through the transistor 41. The relay switch 46 may immediately provide power to the electrical appliance connected to the voltage output terminal 20. 110V live wire is then electrically connected to the electrical appliance so as to switch on the electrical appliance. Thus, the electrical appliance may be electrically connected to a live wire which may supply external AC power (such as 110V or another other AC voltages) to operate the electrical appliance when the magnetic switch 30 closes.

When the magnetic switch 30 detects a second change in magnetic field (from the first change status) and opens (this may correspond to a situation where the door panel 81 is closed with respect to the door frame 82), the switching members 31 may be positioned very close to each other. The turn-off delay circuitry 50 may be activated to delay switching off the relay circuitry 40 and the electrical appliance for a predetermined period of time (such as 2 seconds). The turn-off delay circuitry 50 may adjust the values of the resistance and the capacitance of the fourth resistor 52, the fifth resistor 53 and the third capacitor 54 respectively so as to control the delay period. The formula by which the delay period may be calculated may be obtained by $t=1.1\times R\times C$, where t is the delay period, R is the sum of the resistance of the fourth resistor 52 and the fifth resistor 53, and C is the capacitance of the third capacitor 54. Note that t may be adjusted to be 0. In that case, the delay may be optionally disabled.

Moreover, when the magnetic switch opens, the third capacitor 54 may be charged, and after the delay time t ($t=1.1\times R\times C$), the voltage at pin 2 of second IC 51 may be raised to 8V DC, which is two-third of the 12V DC, and pin 3 of the second IC 53 may go to "Low" to turn off the relay switch 46.

The magnetic switch controlled circuit 1 of the present invention may be utilized to control current inputted to the electrical appliance by controlling the current flowing through the relay circuitry 40. The current flowing through the relay circuitry 40 may be controlled by switching on or switching off at least one magnetic switch 30. The delay circuitry 50 may be added to the magnetic switch controlled circuit 1 so that the switching on or the switching off of the relay circuitry 40 or the electrical appliance may be delayed by a predetermined amount of time, such as few seconds to few minutes. The delay in switching may be accomplished through a resistor and a capacitor connected in a predetermined manner as described above. As mentioned above, the delay circuitry may also be set to have 0 second delay. In other words, the turn-off delay circuitry 50 may optionally be set to have no delay at all.

Advantages of the Present Invention

The magnetic switch controlled circuit 1 of the present invention utilizes the magnetic switch 30 to control the on/off of the electrical appliance such as the electrical air curtain apparatus. Magnetic switches 30 are smaller in size and easier to install when compared to conventional mechanical switches.

Take air curtain apparatus 80 as an example, two switching members 31 of a magnetic switch 30 may be mounted in the vicinity to each other for the magnetic switch controlled circuit 1 to detect the opening or closing of a corresponding door panel 81. The complicated mounting mechanisms for conventional mechanical switches are no longer necessary.

The switching members 31 of the magnetic switch 30 may easily be mounted on the door frame 81 without using any mechanical accessories or connectors. The magnetic switch 30 may simply be adhered to a suitable position on the door frame 82 or the door panel 81. The magnetic switch 30 of the present invention does not involve the use of high voltage or current. 12V DC is a typical operational voltage. The magnetic switch 30 may easily be connected.

When the magnetic switch 30 closes, the relay switch 46 is switched on to supply current to the electrical appliance. When the magnetic switch 30 opens, the relay switch 46 is switched off after a predetermined amount of delay time. The relay circuitry is arranged to continue supplying current to the electrical appliance for a certain period of time. After that, electrical current is cut off from the electrical appliance and the electrical appliance will be switched off.

Take the electrical air curtain apparatus 80 as an example, when the door panel 81 is opened from the door frame 82, the magnetic switch 30 may detect a first change in magnetic field and it may close, and the relay switch 46 may be switched on to supply current to the electrical air curtain apparatus 80. The electrical air curtain apparatus 80 may then generate high pressure air to the door frame 82. Thus, the electrical air curtain apparatus 80 may comprise a casing 83, and a blower fan 84 mounted in the casing 83 for blowing high-speed air at a predetermined direction. The magnetic switch controlled circuit 1 of the present invention may be incorporated in the casing 83 while the switching members 31 are extended from the casing 83 to attach on the door frame 82 and the door panel 81.

When the door panel 81 is closed, the magnetic switch 30 may detect a second change in magnetic field and it may open, the relay switch 46 may be switched off after a predetermined amount of delay time. The relay may be arranged to continue supplying current to the air curtain apparatus 80 for a certain period of time. After that, electrical current may be cut off from the air curtain apparatus 80 and the air curtain apparatus 80 may eventually be switched off.

When the door panel 81 swings in different directions, the door panel 81 will be sequentially opened and closed for a short period of time. The turn-off delay circuitry 50 may prevent the relay switch 46 and the air curtain apparatus 80 from switching on and switching off too abruptly or too frequently in a very short period of time. This prevents the electrical air curtain apparatus 80, especially any motor equipped in the air curtain apparatus 80, from being damaged.

If the magnetic switch controlled circuit 1 of the present invention is utilized to control the on/off of other electrical appliances such as a lighting device, when the magnetic switch 30 closes, the lighting device may be turned on, and when the magnetic switch 30 opens, the lighting device will continue working for a short period of time (due to the turn-off delay circuitry 50) before being eventually turned off.

It is worth mentioning that the magnetic switch controlled circuit 1 may be utilized for other electrical appliances and may not necessarily confined to the use of electrical air curtain apparatus 80. The magnetic switch controlled circuit 1 may be incorporated in other electrical apparatus 80 for controlling the switching on or switching off thereof.

The present invention, while illustrated and described in terms of a preferred embodiment and several alternatives, is not limited to the particular description contained in this specification. Additional alternative or equivalent components could also be used to practice the present invention.

What is claimed is:

1. A magnetic switch controlled circuit for an electrical appliance, comprising:

a voltage input terminal adapted for electrically connecting to an external power source;

a voltage output terminal adapted for electrically connecting to said electrical appliance;

a magnetic switch configured to detect a change in magnetic field, said magnetic switch comprising a plurality of switching members, wherein when said plurality of switching members is positioned apart from each other, said magnetic switch is configured to close so as to supply power to said electrical appliance, wherein when said plurality of switching members is positioned close to each other, said magnetic switch is configured to open so as to cut off power supply to said electrical appliance;

a relay circuitry electrically connected to said magnetic switch, wherein when said magnetic switch detects a first change in said magnetic field from an idle status, said relay circuitry is configured to output an output voltage to said voltage output terminal so as to supply power to said electrical appliance;

a turn-off delay circuitry electrically connected to said relay circuitry, wherein when said magnetic switch detects a second change in said magnetic field from said first change in said magnetic field, said turn-off delay circuitry is configured to control said relay circuitry to continue outputting said output voltage to said voltage output terminal for a predetermined period of delay time, said relay circuitry being switched off by said turn-off delay circuitry after said predetermined period of delay time elapses; and a rectifying circuitry electrically connected between a transformer and said relay circuitry and said turn-off delay circuitry, said rectifying circuitry being configured to rectify alternating current to direct current, and comprising a plurality of diodes arranged in parallel configuration, a filter electrically connected to said diodes, and a first integrated circuit electrically connected to said filter, said filter comprising a first capacitor and a first resistor connected with each other, wherein said relay circuitry comprises a transistor, a second resistor, a second capacitor connected to said second resistor in parallel, a third resistor, a relay diode, and a relay switch, said transistor being a bipolar junction transistor having a base terminal, an emitter terminal and a collector terminal, said emitter terminal being connected to ground and to said second resistor, said base terminal being connected to said second resistor in series, said third resistor being connected between said turn-off delay circuitry and said second capacitor, said relay switch being connected to said collector terminal of said transistor, said relay switch being connected to said relay diode in parallel.

2. The magnetic switch controlled circuit, as recited in claim 1, wherein said turn-off delay circuitry further comprises a second Integrated Circuit (IC), a fourth resistor, a fifth resistor, and third through sixth capacitor, said second IC having first through eighth pins and being programmed to control said operation of said relay circuitry.

3. The magnetic switch controlled circuit, as recited in claim 2, wherein said first pin of said second IC is connected to ground, and to said third capacitor and said fourth capacitor, said second pin of said second IC being connected to said fourth resistor, said fifth resistor, said sixth capacitor, and said magnetic switch, said third pin of said second IC being connected to said third resistor of said relay circuitry, said fourth pin of said second IC being connected to said eighth pin of said second IC, said first IC of said rectifying circuitry, said relay diode and said relay switch, said fifth pin of said second IC being connected to said fourth capacitor, said first pin of said second IC, and to said third capacitor, said sixth pin of said second IC being connected to said third capacitor, said seventh pin of said second IC, and said fifth resistor, said seventh pin of said second IC being further connected to said third capacitor, and said fifth resistor, said eighth pin of said second IC being further connected to said relay circuitry, and said rectifying circuitry.

4. The magnetic switch controlled circuit, as recited in claim 3, wherein said delay time is obtained by multiplying 1.1 by a sum of a resistance of said fourth resistor and said fifth resistor, and by a capacitance of said third capacitor.

5. The magnetic switch controlled circuit, as recited in claim 4, wherein when said magnetic switch opens, said third capacitor is charged for a predetermined period of delay time, and after said predetermined period of delay time elapses, a voltage at said second pin of said second IC being be raised to a predetermined DC voltage, and said third pin of said second IC being configured to turn off said relay switch.

6. The magnetic switch controlled circuit, as recited in claim 5, wherein when said magnetic switch closes, said DC rectified by said rectifying circuitry is arranged to trigger said relay circuitry which turns on main power source of said electrical appliance, said magnetic switch being arranged to close and pull a voltage of said second pin of said second IC to ground, said third pin of said second IC being arranged to turn on said relay switch through said transistor so that said relay switch is arranged to provide power to said electrical appliance.

7. The magnetic switch controlled circuit, as recited in claim 2, wherein said transformer is configured to convert current drawn from said external power source to a stepped-down power.

8. The magnetic switch controlled circuit, as recited in claim 6, wherein said transformer is configured to convert current drawn from said external power source to a stepped-down power.

9. The magnetic switch controlled circuit, as recited in claim 4, further comprising a replaceable fuse electrically connected to said relay circuitry and said turn-off delay circuitry.

10. The magnetic switch controlled circuit, as recited in claim 8, further comprising a replaceable fuse electrically connected to said relay circuitry and said turn-off delay circuitry.

* * * * *